US005406929A

United States Patent [19]

Udert et al.

[11] Patent Number: 5,406,929

[45] Date of Patent: Apr. 18, 1995

[54] GRINDING TOOL BIT

[75] Inventors: Karl E. Udert, Triesen, Liechtenstein; Johann Dorfmeister, Feldkirch-Tisis, Austria

[73] Assignee: Hilti Aktiengesellschaft, Furstentum, Liechtenstein

[21] Appl. No.: 169,845

[22] Filed: Dec. 17, 1993

[30] Foreign Application Priority Data

Dec. 18, 1992 [DE] Germany ..... 42 43 017.8

[51] Int. Cl.[6] ..... B28D 1/12

[52] U.S. Cl. ..... 125/15; 451/542; 451/449

[58] Field of Search ..... 51/206 R, 206 P, 206.4, 51/209 R, 266; 125/15, 13.01

[56] References Cited

U.S. PATENT DOCUMENTS

| | | | |
|---|---|---|---|
| 47,255 | 4/1865 | Drake | 125/15 |
| 2,020,117 | 11/1935 | Johnston | 51/209 R |
| 2,073,678 | 3/1937 | Broughton | 125/15 |
| 4,114,322 | 9/1978 | Greenspan | 51/209 R |
| 5,243,811 | 9/1993 | Kitabayashi et al. | 51/207 |

FOREIGN PATENT DOCUMENTS

| | | | |
|---|---|---|---|
| 8402300 | 6/1984 | WIPO | 51/206 R |

*Primary Examiner*—Robert A. Rose
*Attorney, Agent, or Firm*—Anderson Kill Olick & Oshinsky

[57] ABSTRACT

A grinding tool bit is formed of a disk-shaped base member (1) with a central through opening (6) for attaching the base member to a drive spindle of a machine tool. The base member (1) is covered with individual cutting elements (4) at the radially outer circumferential surface (2) and in the side faces (3) adjacent the outer circumferential surface (2).

9 Claims, 4 Drawing Sheets

GRINDING TOOL BIT

BACKGROUND OF THE INVENTION

The present invention is directed to grinding tool bit formed of a disk-shaped base member covered with cutting elements on its radially outer circumferential surface and on a region of at least one side face adjacent the circumferential surface.

Grinding tools or tool bits of the above type are used for cutting or grinding hard materials, such as concrete or rock.

A grinding tool is disclosed in DE-OS 35 13 687 including a disk-shaped base member covered with diamond grains at its radially outer circumferential surface as well as on its side faces.

While this known grinding tool can be used as a cutting disk or as a slot cutter, surface grinding is only marginally possible, since the disk-shaped base member has a constant thickness. With the grinding tool inclined relative to the surface to be worked, only the circumferential contour rests on the surface to be worked and the grinding surface proper is spaced from the surface to be worked. If the grinding tool is placed in a parallel position with respect to the surface to be worked, all of the cutting elements on one side face would be in contact with the surface to be worked, however, such position involves migration of the grinding tool on the surface to be worked.

SUMMARY OF THE INVENTION

Therefore, the primary object of the present invention is to provide a universal grinding tool bit having a long useful life which can be fabricated economically and which is suited for grinding surfaces as well as for use as a cutting disk and as a slot cutter.

In accordance with the present invention, the width of the base member diminishes or tapers toward the radially outer circumferential surface with the cutting elements bonded to the base member by solder whereby the cutting elements cover at least the tapering side surfaces. The cutting elements are spaced relative to one another at a spacing corresponding to one to ten times the diameter of a single cutting element measured parallel to the plane of one side face of the base member.

As a result, a grinding surface is provided by the base member where its width or thickness decreases toward the outer circumferential surface with the tapering surfaces disposed at a specific inclination relative to the other side face. Such inclined grinding face or surface enables the oblique or inclined set-up of the grinding tool bit at the surface to be worked during the grinding operation. Accordingly, migration of the tool bit during the grinding process is prevented.

The attachment of the individual cutting elements is provided by solder, which has the property of effectively bonding the individual cutting elements to the base member. Using solder has the advantage that only about 20% to 25% of the cutting element has to be embedded in the solder.

When the tool bit is used for chip removal of a material tending to clog or glaze, the spacing between the individual elements is preferably larger than when a hard surface is ground with the spacing limit being in a range of one to ten times the diameter of one cutting element. The base member of the grinding tool bit can be formed of steel, metal alloy, ceramic material or sintered metal.

The width or thickness of the base member tapers symmetrically on both sides. The region of the base member decreasing in width towards the radially outer circumferential surface is particularly suited for grinding surfaces. Due to the symmetrical configuration of both side faces of the base member, each side face can be used for identical surface grinding.

At least in the region of the base member having a decreasing thickness, it is advantageous to provide areas free of cutting elements. Such areas free of cutting elements serve for improved removal of grinding dust resulting from a considerable increase in the material removed in the grinding operation. These areas free of cutting elements provide for a distribution of a cooling medium across the side faces during wet grinding of the surface. The areas free of cutting elements can extend in part from the center to the outer circumferential surface of the base member. These areas free of cutting elements divide the region of the base member covered with cutting elements into several smaller surfaces which extend at least in part from the center to the outer circumferential surface of the grinding tool bit. Areas free of cutting elements can be made of different widths. The shape of such areas can also differ. For instance, such areas can extend radially, in a twist-shaped manner or a spirally-shaped manner with the direction of the twist and of the spiral extending in a direction opposite to the rotational direction of the grinding tool bit. With such a directional orientation of the areas free of the cutting elements there results an effective removal of the grinding dust.

For more effective removal of the grinding dust, the areas of the base member free of cutting elements are preferably shaped as depressions in the base member. During wet cutting operations, the depressions afford flow of a cooling medium from the center toward the radially outer circumferentially extending surface of the base member.

The depressions or recesses extend at least partially from the center towards the outer diameter of the base member and result in the division of the large side faces of the base member into several smaller surfaces, which at least in part also extend from the center towards the outer circumferential surface of the grinding tool bit. The recesses can be of different width, so that their width increases from the center towards the outer circumferential surface of the grinding tool bit. Accordingly, recesses or depressions with a circular segment-like shape are formed.

Spiral-shaped depressions having a twist direction extending counter to the rotational direction of the grinding tool bit, form effective removal channels for the grinding dust forming in the grinding operation. Such depressions are particularly suited for wet grinding for distributing the cooling medium supplied to the grinding tool bit during the grinding operation, for instance, through a drive spindle of a driving device. Accordingly, the cooling medium flows from the center across the side faces of the grinding tool.

Preferably, the base member has the depressions or recesses in spaced areas located between the cutting elements. The base member may have knob-like surfaces in the region where the cutting elements are to be placed prior to the application of the cutting elements. The individual cutting elements of the grinding tool bit are arranged to be bonded by solder to small cylindrical or conically truncated knobs. The diameter of the faces of the knobs on which the individual cutting elements are placed is slightly greater than the largest diameter of the individual cutting elements.

Distribution of a cooling medium is possible in the spaced areas in the event wet grinding is used. Furthermore, spaced areas afford improved removal of the dust developed during the grinding operation, towards the outer circumference of the grinding tool bit.

Preferably, the cutting elements are each formed by one diamond grain. Considerable material removal output is attained by arranging the individual diamond grains in spaced relation, since the individual diamond grains penetrate deeper into the surface of the material being worked.

The disk-shaped base member can also be covered with cutting elements advantageously made up of a group of two to eight individual diamond grains. By using groups of diamond grains, a larger grinding area is formed, particularly suited for grinding hard materials. The groups of diamond grains penetrate less deeply into the surface of the material being worked whereby surface roughness is limited.

Depending on the wear behavior of the individual cutting elements, the spacing between the individual cutting elements or groups can differ.

Preferably, the cutting elements are placed on a base member by using a template containing holes to obtain the desired distribution of the individual cutting elements on the side faces or at the radially outer circumferential surface of the grinding tool bit. The base member is provided with appropriate solder for bonding the individual cutting elements and if necessary the pattern of the template holes is located above the solder and the cutting elements are spread across the template. The cutting elements are arranged in a desired manner by appropriate through openings spaced from one another in the template so that the cutting elements pass through the through openings into the solder and are bonded to the base member.

The cutting elements are arranged in a single layer at the outer circumferential surface and in the adjacent region of the side faces.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
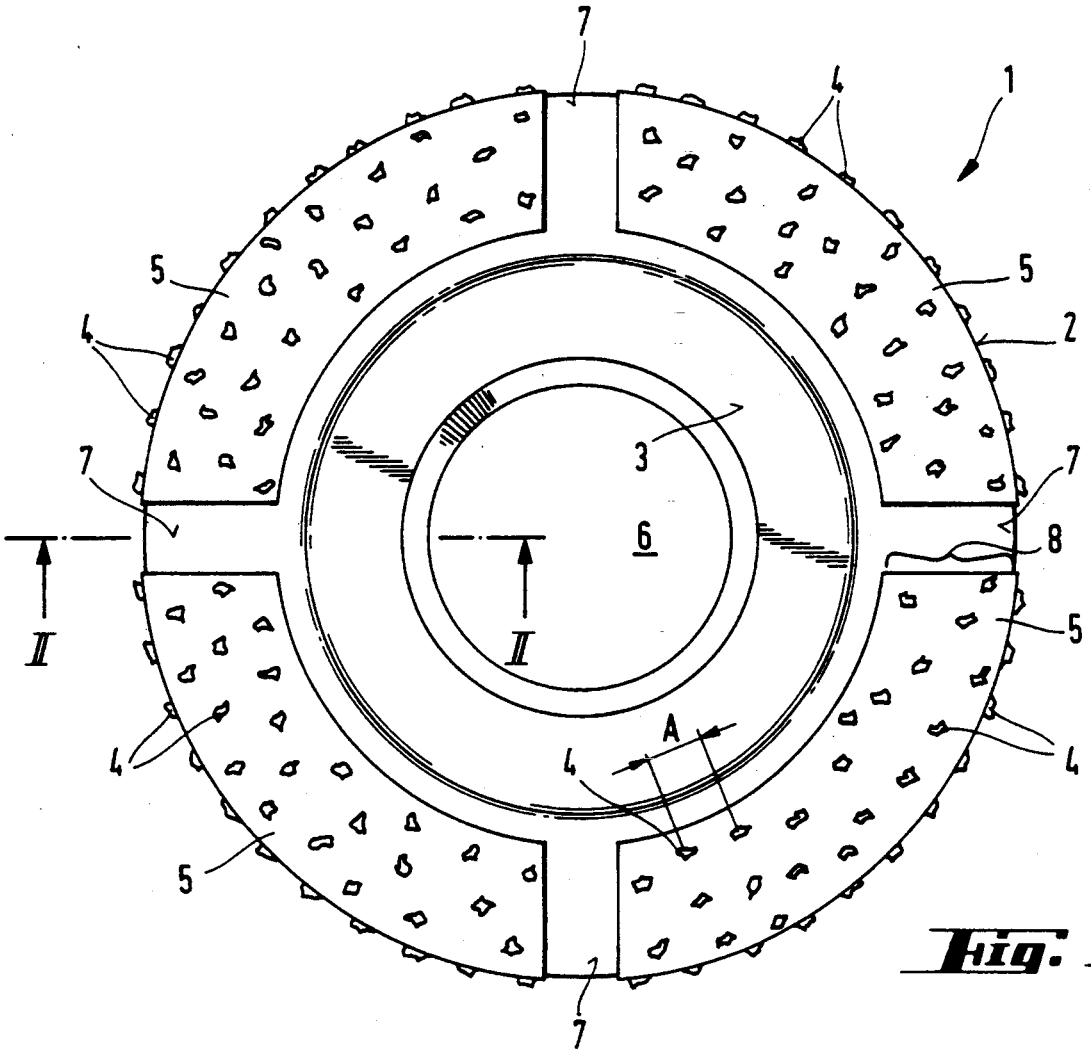
FIG. 1 is a plan view of a grinding tool bit embodying the present invention with cutting elements arranged at the radially outer circumferential surface and also on the side faces.
Figure 2:
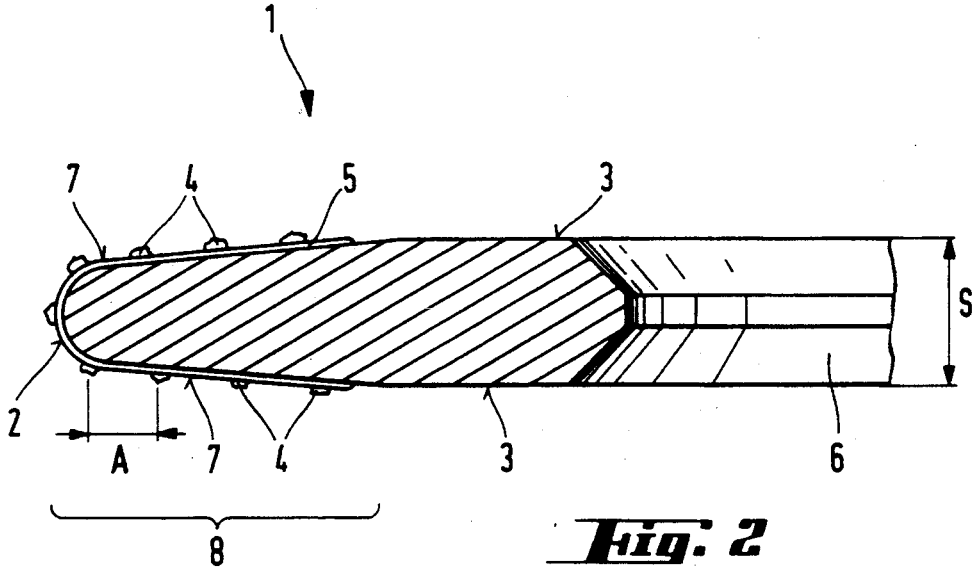
FIG. 2 is an enlarged sectional view of the base member taken along the line II—II in FIG. 1.

FIGS. 1 and 2 illustrate a circular-shaped annular base member 1 with side faces or surfaces 3 covered with individual cutting elements 4. Carrier member 1 has a radially outer annular region 8 with its thickness S decreasing towards the radially outer circumferential surface 2. Further, the base member 1 has a central through opening 6 for attaching the grinding tool bit to a drive shaft of a machine tool, not shown.

The through opening 6 is designed so that part of a device with a frusto-conical shaped surface can be inserted from both side faces 3 into the through opening 6. The side faces 3 of the base member 1 are partially covered with solder 5 for bonding the individual cutting elements to the base member. The individual cutting elements 4 are spaced apart from one another at a spacing A. In the annular region 8, the grinding tool bit has areas 7 free of cutting elements and these areas serve for improved removal of dust developed in the grinding operation.

FIG. 2 displays an enlarged sectional view of the base member 1. The section II—II through the base member 1 extends through an area 7 free of cutting elements. Individual cutting elements 4 are located on the radially outer circumferential surface 2 as well as in the adjacent annular region 8 of the side faces 3.

Figure 3:
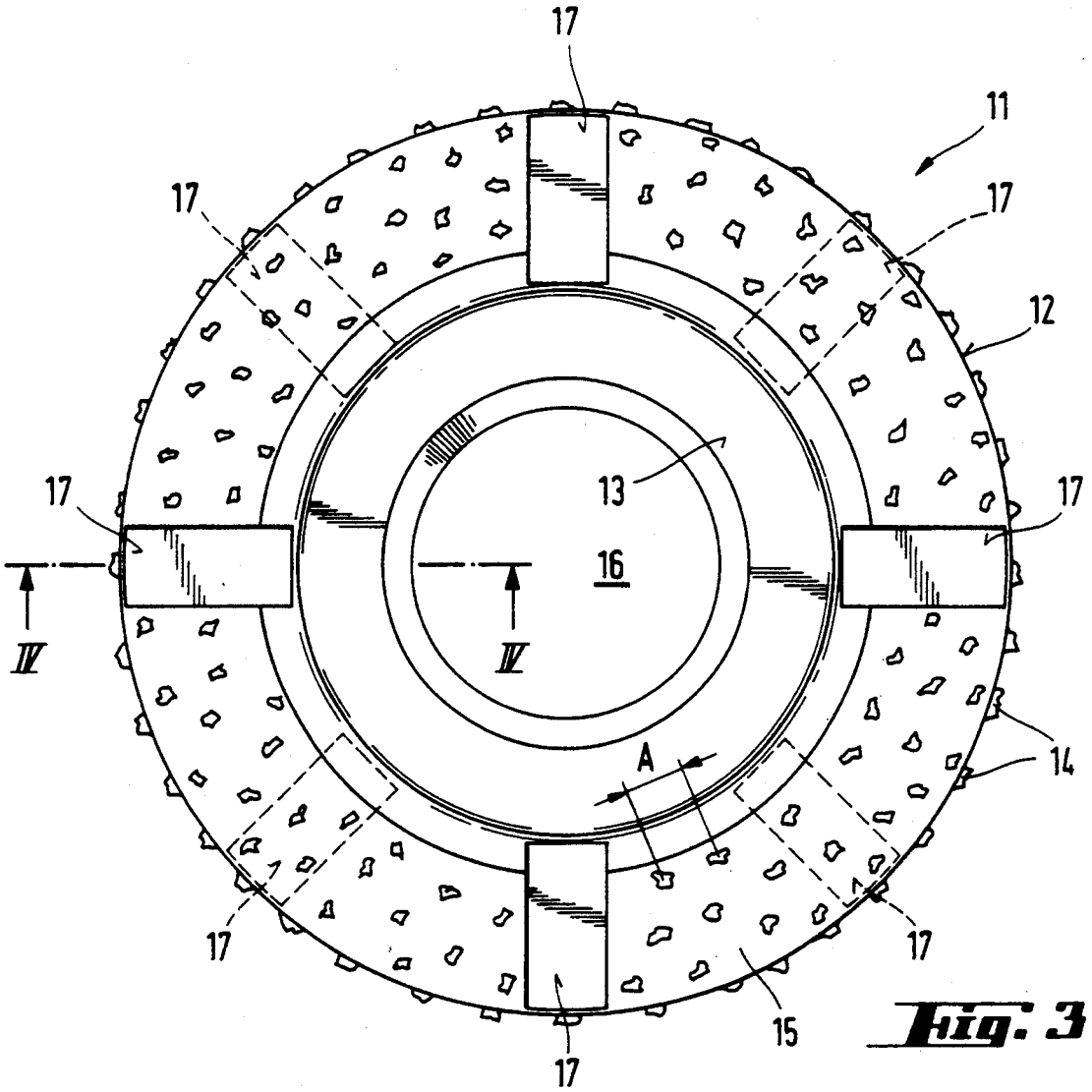
FIG. 3 is a view similar to FIG. 1 illustrating another grinding tool bit embodying the present invention and including depressions in the base member.
Figure 4:
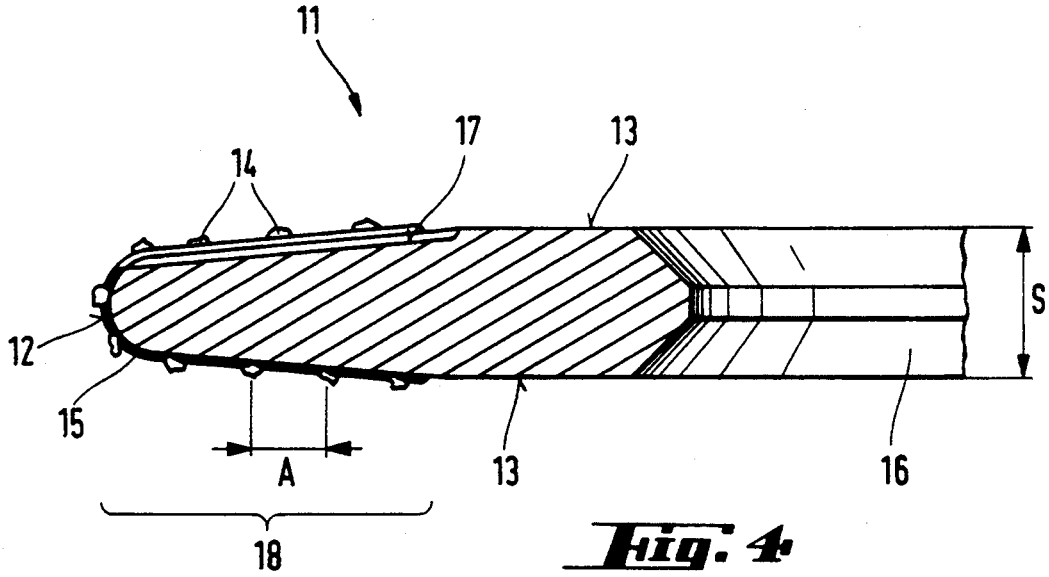
FIG. 4 is an enlarged sectional view of the base member taken along the line IV—IV in FIG. 3.

FIGS. 3 and 4 exhibit another circular-shaped annular base member 11 with basically radially extending areas 17 free of cutting elements with the areas formed as recesses or depressions in the side faces 13. If such depressed areas are disposed on both side faces 13, then the depressions on the side faces are offset relative to one another, whereby the base member 11 is not weakened in the location of the depressions, note the depression shown in dashed lines in FIG. 3.

The depressions can extend radially inwardly from a radially outer circumferential surface 12 or in the region 18 of the side faces 13 adjacent the outer circumferential surface towards the through opening 16. The cutting elements 14 secured on the base member 11 are individual diamond grains, embedded in solder 15 applied on the base member. The cutting elements 14 are located on the base member 11 in an ordered or random manner. In either case, however, the individual cutting elements 14 have a specific spacing A from one another. The spacing A can vary as a function of the material to be ground. It is also possible to arrange more cutting elements 14 at a smaller spacing A from one another at the outer circumferential surface 12 or in the adjacent region of the side faces 13 next to the outer circumferential surface, than in the part of the side faces 13 located closer to the through opening 16. Effective removal of the dust developed in the grinding operation is provided by the areas 17 free of cutting elements formed as depressions.

The through opening 16 located in the center of the base member 11 serves for fastening the grinding tool bit to a drive shaft and machine tool, not shown. Base member 11 tapers symmetrically inwardly in the axially extending surface of the through opening 16. In such a through opening 16, the attachment device of a drive spindle shaped complementarily to the taper can be received so that it does not project beyond one of the side faces 13 of the carrier member 11.

The enlarged sectional view of the base member 11 shown in FIG. 4 displays the region 18 of the base member having a thickness S decreasing symmetrically towards the radially outer circumferential surface 12. FIG. 4 also shows the through opening 16 and the areas 17 in the form of depressions free of the cutting elements which extend from the outer circumferential surface 12 across the adjacent region 18 of the side face 16 extending radially inwardly from the circumferential surface. Further it can be noted from FIG. 4 that the depressions 17 on the lower side face 13 of the base member 11 are not visible, since the depressions in one side face 13 are offset angularly with respect to the depressions in the other side face 13.

Figure 5:
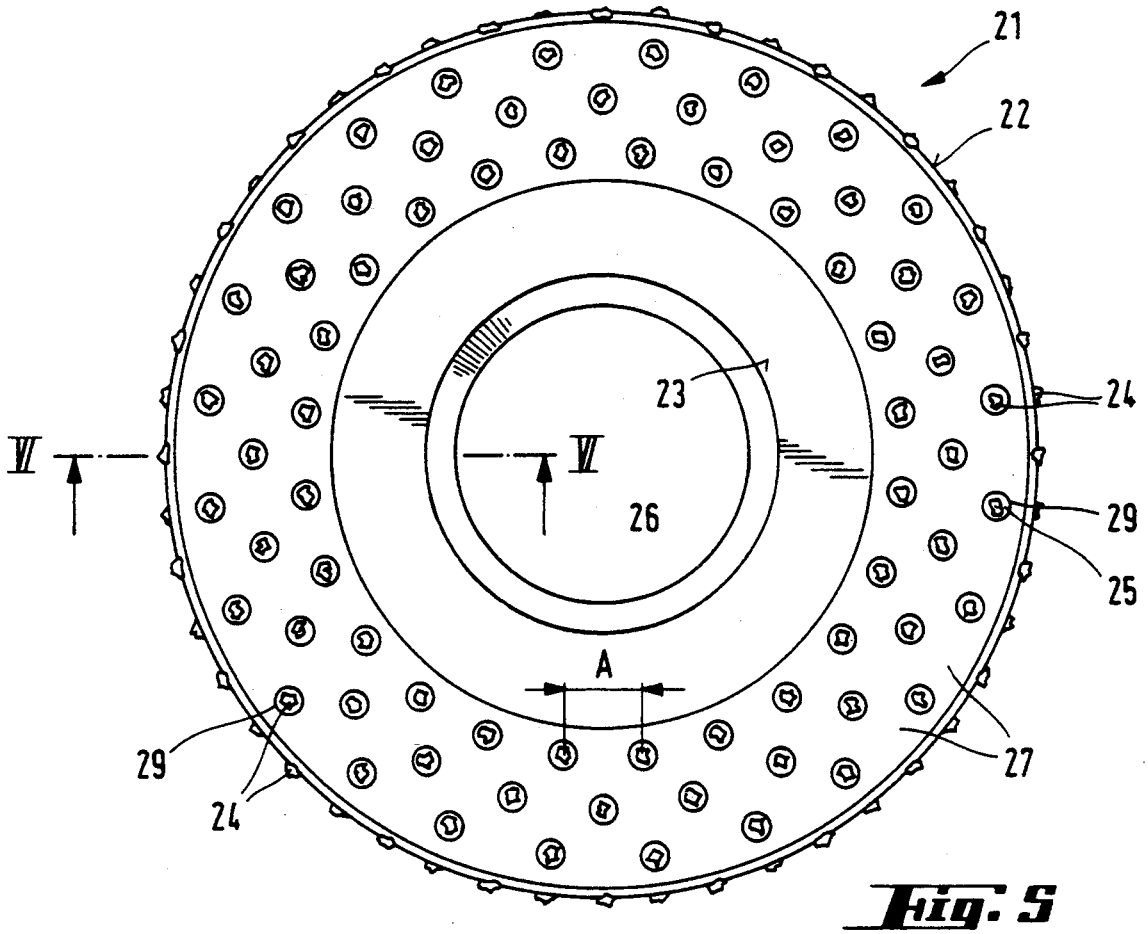
FIG. 5 is a view similar to FIGS. 1 and 3 of still another grinding tool bit embodying the present invention with cutting elements positioned on knob-like surfaces of the base member.
Figure 6:
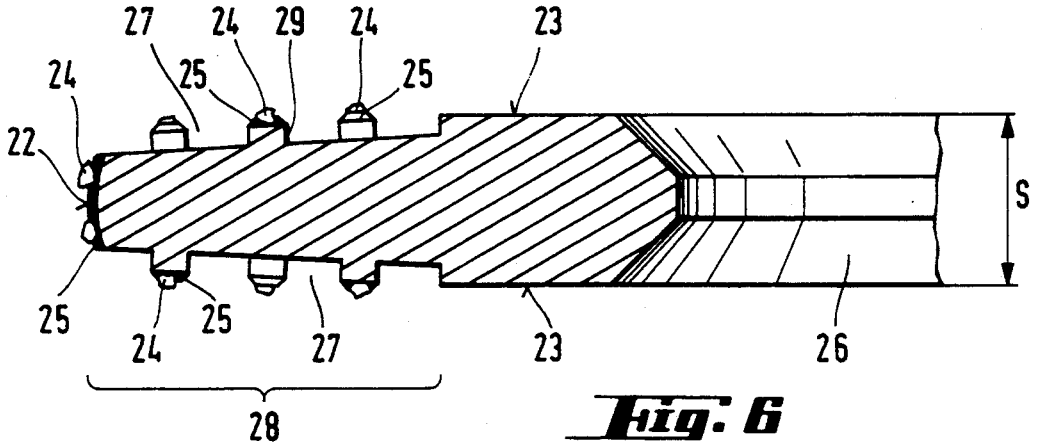
FIG. 6 is an enlarged sectional view of the base member taken along the line VI—VI in FIG. 5.

In FIGS. 5 and 6 a circular-shaped annular base member 21 is covered with cutting elements 24 at the radially outer circumferential surface 22 and in the adjacent region of the side faces 23. The cutting elements 24 are arranged on the base member 21 spaced from one another at the spacing A.

The enlarged sectional view in FIG. 6 of the base member 21 shows the radially outer region 28 of the base member 21 where the thickness S decreases symmetrically with the open spaces 27 located between the individual cutting elements 24. The cutting elements 24 are located in the outer circumferential surface 22 and the spaces 27 recessed in the region 28 of the side faces 23 form knobs 29.

Knobs 29 are basically cylindrical with an individual cutting element 24 secured on each knob by solder 25. The cutting element may be a single cutting grain or a group of two to eight diamond grains. The diameter of the knobs 29 is slightly greater than the diameter of an individual cutting element 24. The formation of such a base member 21 and the disposition of the knobs 29 is arranged in a predetermined pattern. It is necessary for the application of the solder 25 and the individual cutting elements 24 to use a hole template with through openings, not shown, with the openings having a diameter such that the individual cutting elements 24 can pass therethrough. The openings of the hole template form the pattern which is identical with the arrangement of pattern in knobs 29 on the base member 21.

A through opening 26 is located in the center of the base member 21 and serves for securing the grinding tool bit to a drive shaft of the machine tool, not shown. In the base member 21 the surface of the through opening 26 tapers symmetrically inwardly on both sides to a central cylindrically-shaped region.

Figure 7:
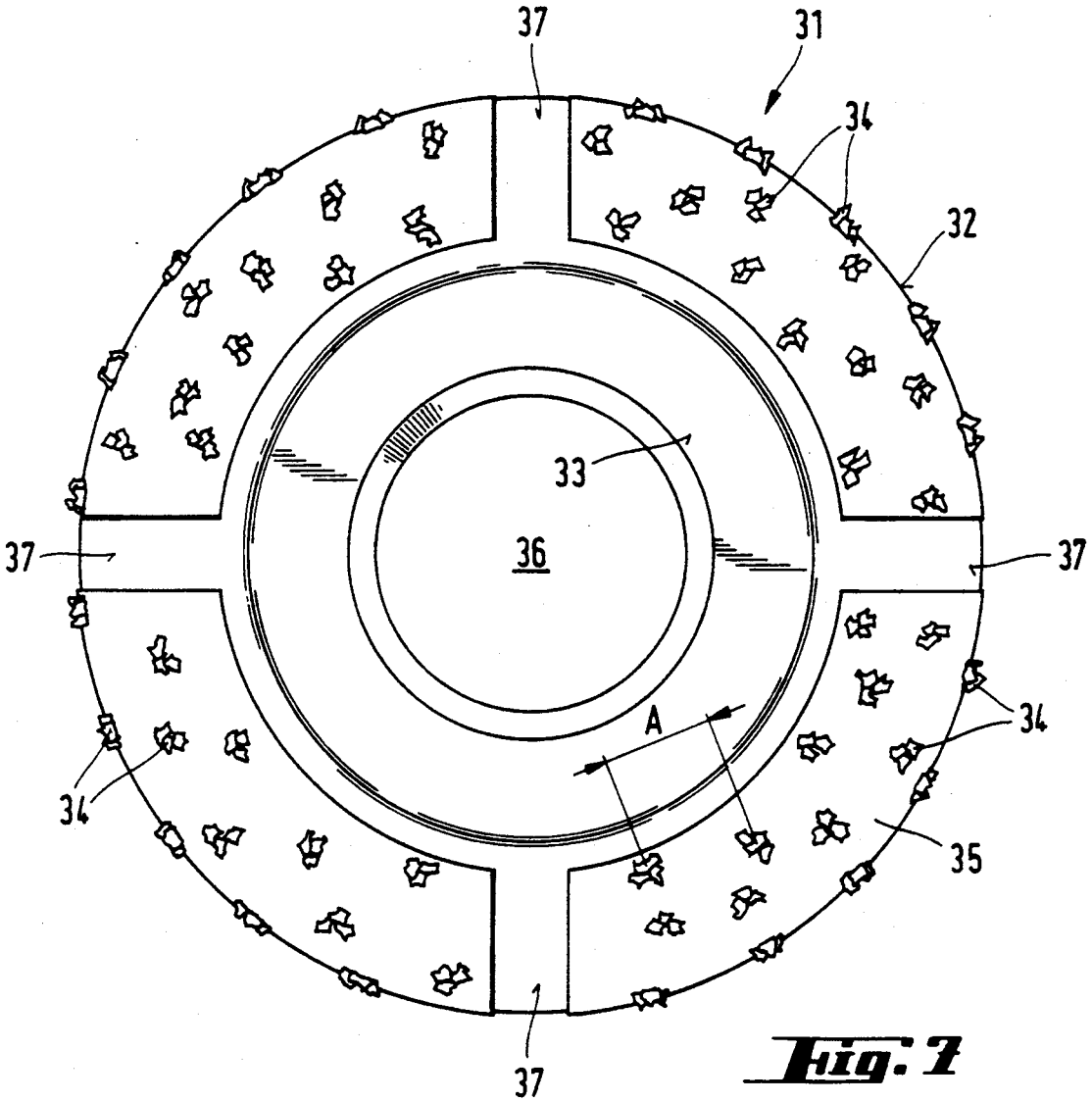
FIG. 7 is a view similar to FIGS. 1, 3 and 5 displaying yet another grinding tool bit embodying the present invention with the cutting elements arranged in individual groups on the base member.

In FIG. 7 a grinding tool bit is illustrated formed of a circular ring-shaped base member 31 with a centrally located through opening 36. Base member 31 is provided at least partially with solder 35 on the radially outer circumferential surface 32 and in the adjacent region of the side faces 33, with the solder bonding the cutting elements 34 to the base member 31. Cutting elements are arranged on the base member 31 forming a single layer in groups of two to eight individual diamond grains. The groups are arranged at the radially outer circumferential surface 32 as well as in the adjacent region of the side faces 33 with a spacing A from one another.

Base member 31 has radially extending areas 37 free of cutting elements with the areas serving for better removal of the dust generated during the grinding operation on a work piece. There is no solder 35 in the areas 37 free of cutting elements.

While a specific embodiment of the invention has been shown and described in detail to illustrate the inventive principles, it will be understood that the invention may be embodied otherwise without departing from said principles.

We claim:

1. A grinding tool comprising a disk-shaped base member (1, 11, 21, 31) having a central axis, a radially outer surface (2, 12, 22, 32) extending generally in the axial direction, and a pair of opposite side faces (3, 13, 23, 33) extending radially inwardly from said outer surface transversely of the central axis, cutting elements (4, 14, 24, 34) located on the outer surface (2, 12, 22, 32) and at least on one of said side faces (3, 13, 23, 33) adjacent to said outer surface, wherein the improvement comprises that said side faces (3, 13, 23, 33) of said base member (1, 11, 21, 31) have a central region and a radially outer region (8, 18, 38) encircling said central region and extending to said outer surface, said central region has a thickness (S) and said outer region has a thickness decreasing from the thickness (S) of said central region to said outer surface, said cutting elements (4, 14, 24, 34) are bonded by solder (5, 15, 25, 35) to said base member (1, 11, 21, 31) in at least said outer region of decreasing thickness, with said cutting elements located in said outer region being separated, at least in a radial direction, at a spacing (A) from one another and said spacing (A) being in a range of one to ten times the diameter of one cutting element measured parallel to the plane of said side surface (3, 13, 23, 33) of said base member (1, 11, 21, 31).

2. Grinding tool bit, as set forth in claim 1, wherein the thickness (S) of said member (1, 11, 21, 31) decreases symmetrically on both said side faces.

3. Grinding tool bit, as set forth in claim 1 or 2, wherein said base member (1, 11, 21, 31) has spaced areas (7, 17, 37) free of cutting elements in at least said radially outer region (8, 18, 38) having the decreasing thickness.

4. Grinding tool bit, as set forth in claim 3, wherein said cutting elements (4, 14, 24) are formed by one diamond grain.

5. Grinding tool bit, as set forth in claim 3, wherein said cutting elements (34) are formed by a group of individual diamond grains in the range of two to eight diamond grains.

6. Grinding tool, as set forth in claim 3, wherein said cutting elements (4, 14, 24, 34) are applied to said base member (1, 11, 21, 31) by a template containing holes.

7. A grinding tool comprising a disk-shaped base member (1, 11, 21, 31) having a central axis, a radially outer surface (2, 12, 22, 32) extending generally in the axial direction, and a pair of opposite side faces (3, 13, 23, 33) extending radially inwardly from said outer surface transversely of the central axis, cutting elements (4, 14, 24, 34) located on the outer surface (2, 12, 22, 32) and at least on one of said side faces (3, 13, 23, 33) adjacent to said outer surface, wherein the improvement comprises that said side faces (3, 13, 23, 33) of said base member (1, 11, 21, 31) have a central region and a radially outer region (8, 18, 38) encircling said central region and extending to said outer surface, said central region has a thickness (S) and said outer region has a thickness decreasing from the thickness (S) of said central region to said outer surface, said cutting elements (4, 14, 24, 34) are bonded by solder (5, 15, 25, 35) to said base member (1, 11, 21, 31) in at least said outer region of decreasing thickness, said cutting elements are separated at a spacing (A) from one another and said spacing (A) is in a range of one to ten times the diameter of one cutting element measured parallel to the plane of said side surface (3, 13, 23, 33) of said base member (1, 11, 21, 31), said base member (1, 11, 21, 31) has spaced areas (7, 17, 37) free of cutting elements in at least said radially outer region (8, 18, 38) having the decreasing thickness, and the areas (17) of said base member (11) free of cutting elements are formed as depressions in said base member (11).

8. A grinding tool comprising a disk-shaped base member (1, 11, 21, 31) having a central axis, a radially outer surface (2, 12, 22, 32) extending generally in the axial direction, and a pair of opposite side faces (3, 13, 23, 33) extending radially inwardly from said outer surface transversely of the central axis, cutting elements (4, 14, 24, 34) located on the outer surface (2, 12, 22, 32) and at least on one of said side faces (3, 13, 23, 33) adjacent to said outer surface, wherein the improvement comprises that said side faces (3, 13, 23, 33) of said base member (1, 11, 21, 31) have a central region and a radially outer region (8, 18, 38) encircling said central region and extending to said outer surface, said central region has a thickness (S) and said outer region has a thickness decreasing from the thickness (S) of said central region to said outer surface, said cutting elements (4, 14, 24, 34) are bonded by solder (5, 15, 25, 35) to said base member (1, 11, 21, 31) in at least said outer region of decreasing thickness, said cutting elements are separated at a spacing (A) from one another and said spacing (A) is in a range of one to ten times the diameter of one cutting element measured parallel to the plane of said side surface (3, 13, 23, 33) of said base member (1, 11, 21, 31), said base member (1, 11, 21, 31) has spaced areas (7, 17, 37) free of cutting elements in at least said radially outer region (8, 18, 38) having the decreasing thickness, and said base member (21) is recessed in said spaced areas (27) located between said cutting elements (24).

9. A grinding tool bit as set forth in claim 1, wherein said outer region has a length exceeding the thickness of said central region.

* * * * *